US011326352B2

(12) United States Patent
Bishop

(10) Patent No.: US 11,326,352 B2
(45) Date of Patent: May 10, 2022

(54) BUILDING-WALL FLEXIBLE CLADDING

(71) Applicant: PAUL JAMES BISHOP IP HOLDINGS LIMITED, Tamworth (GB)

(72) Inventor: Paul Bishop, Gloucestershire (GB)

(73) Assignee: PAUL JAMES BISHOP IP HOLDINGS LIMITED, Tamworth (GB)

( * ) Notice: Subject to any disclaimer, the term of this patent is extended or adjusted under 35 U.S.C. 154(b) by 0 days.

(21) Appl. No.: 17/257,499

(22) PCT Filed: Jun. 28, 2019

(86) PCT No.: PCT/GB2019/051850
§ 371 (c)(1),
(2) Date: Dec. 31, 2020

(87) PCT Pub. No.: WO2020/008176
PCT Pub. Date: Jan. 9, 2020

(65) Prior Publication Data

US 2021/0230879 A1 Jul. 29, 2021

(30) Foreign Application Priority Data

Jul. 5, 2018 (GB) ..... 1811087

(51) Int. Cl.
*E04F 13/08* (2006.01)
*E04F 13/18* (2006.01)
(Continued)

(52) U.S. Cl.
CPC ..... *E04F 13/0862* (2013.01); *E04F 13/18* (2013.01); *B44C 1/24* (2013.01); *D06N 7/0092* (2013.01)

(58) Field of Classification Search
CPC ..... E04F 13/0862; E04F 13/18; E04F 13/147; B44F 11/06; B44C 1/24; B44C 5/0461; D06N 7/0092; D06Q 1/00; B32B 3/16
See application file for complete search history.

(56) References Cited

U.S. PATENT DOCUMENTS 3,312,761 A * 4/1967 Vida ..... E04F 13/185 264/77
4,288,486 A * 9/1981 Ferment ..... D06N 7/0007 427/244
(Continued)

FOREIGN PATENT DOCUMENTS

CA 1211924 A 9/1986
DE 102013101521 A1 8/2014
(Continued)

OTHER PUBLICATIONS

Search Report of the GB Intellectual Property Office of Application No. GB1811087.4, dated Nov. 15, 2018.
(Continued)

*Primary Examiner* — Paola Agudelo
*Assistant Examiner* — Adam G Barlow
(74) *Attorney, Agent, or Firm* — Kim IP Law Group LLC

(57) ABSTRACT

A method of manufacturing building-wall flexible cladding (12) for a wall of a building so that a cladding outer surface of the building-wall flexible cladding (12) matches or substantially matches a textured wall surface of the wall of the building. This is first achieved by selecting the wall to be modelled (S101) and forming an impression of the wall (S102). An absorbent flexible substrate (18) is provided (S103), and a wet mixture (24) created (S105) and applied to the substrate (18, S106) to form one or more tiles (24*a*). The wet mixture (24) is textured by applying the impression so that the cladding outer surface corresponds or substan-
(Continued)

tially corresponds to the said textured wall surface (S108). Finally, the textured wet mixture is cured (S109).

11 Claims, 5 Drawing Sheets

(51) Int. Cl.
*B44C 1/24* (2006.01)
*D06N 7/00* (2006.01)

(56) References Cited

U.S. PATENT DOCUMENTS 5,167,991 A 12/1992 Lowe
6,237,294 B1 * 5/2001 Rygiel ..... B28B 7/007 264/220
9,744,644 B2 * 8/2017 Spires ..... B05D 3/12
10,487,516 B2 * 11/2019 Bishop ..... B32B 5/024
2010/0173070 A1 * 7/2010 Niu ..... B01J 35/0013 427/215
2018/0051155 A1 * 2/2018 Nair ..... D06M 15/19
2021/0230879 A1 * 7/2021 Bishop ..... E04F 13/18

FOREIGN PATENT DOCUMENTS

GB 2548156 A 9/2017
JP H05185566 A 7/1993
JP H11165378 A 6/1999
JP H05185566 A 7/1999

OTHER PUBLICATIONS

International Search Report and Written Opinion of Application No. PCT/GB2019/051850, dated Oct. 29, 2019.

* cited by examiner

BUILDING-WALL FLEXIBLE CLADDING

CROSS-REFERENCE TO RELATED APPLICATIONS

This application is a U.S. national phase application under 35 U.S.C. § 371 of International Application No, PCT/GB2019/051850, filed on Jun. 28. 2019, which claims priority to GB Patent Application No. 1811087.4 filed on Jul. 5, 2018, the disclosures of each of which are hereby incorporated by reference in their entirety for all purposes.

The present invention relates to a method of manufacturing building-wall flexible cladding suitable for applying to a wall. The invention further relates to building-wall-flexible-cladding manufacture system.

Cladding for buildings, such as domestic and commercial premises, is known, and traditionally comes in individual tiles which are laboriously applied by hand to the exterior wall of the building, before grouting is then applied between the tiles. However, the tiles first have to be produced, and these may either be moulded plastics, which are low-cost and have minimal longevity, or may be sliced from pre-manufactured brick. This latter case is hugely wasteful, since only the outer surface is required and thus around 90% of the brick is then discarded, typically being disposed of in landfill.

Other options for cladding exist, such as plaster or render stucco material. However, such outer layers on buildings are prone to cracking over a relatively short period of time due to the impact of seasonal climate change, along with relatively rapid fading. This results in a non-uniform appearance of the wall.

Furthermore, current cladding is highly repetitious, leading to a clearly unnatural finish and one which cannot be matched to the surrounding built and historical environment.

It is known to provide panelled cladding for a building, wherein an outwardly facing layer of the cladding can be matched to the finish of the building. However, typically only the colour is matched and if the exterior wall has a weathered appearance, the un-weathered cladding would not match the appearance of the wall producing a discrepancy or an unnatural finish.

The present invention seeks to provide a solution to these problems.

According to a first aspect of the present invention, there is provided a method of manufacturing building-wall flexible cladding for a wall of a building so that a cladding outer surface of the building-wall flexible cladding matches or substantially matches a textured wall surface of the wall of the building, the method comprising the steps: selecting at least part of the textured wall surface to be modelled; forming an impression of said selected part of the textured wall surface; providing an absorbent flexible substrate; creating a wet mixture comprising a powdered aggregate and a binding agent; applying the wet mixture to the flexible substrate to form one or more tiles; texturing the wet mixture by applying the impression so that the cladding outer surface corresponds or substantially corresponds to the said textured wall surface; and curing said textured wet mixture to form building-wall flexible cladding.

By producing an impression of part of the wall which the cladding is to be applied, and then texturing the cladding with the impression, the cladding is able to directly match or correspond to the wall to which it is covering and/or replacing. This may allow for a more convincing natural finish for the cladding given that the cladding is able to take on the appearance and relief of an older wall which has been subject to weathering and/or other damage. Flexible cladding enables the cladding sheets to be rolled so as to be easily stored and to be easily applied to curvate surfaces of the wall. The cladding may therefore be provided as a wrap.

Preferably, during step b. an impressing element may be formed using the impression and during step f. the impressing element may be applied to the wet mixture. An impressing element is able to quickly and inexpensively texture the wet mixture through physical deformation of the wet mixture, as compared to casting the wet mixture with such a texture or laser cutting the wet mixture.

Advantageously, the impressing element may be stamped onto the wet mixture. A stamping element allows for a quicker application of the impression to a discrete cladding element as compared to, for example, a roller.

Beneficially, in step b. the impression may be formed via applying a moulding element to said textured surface of the wall. A physical moulding element enables the impression of the relief of the wall to be formed simply without requiring complex scanning equipment.

In a preferable embodiment, the moulding element may comprise latex. Latex may be applied in a liquid form to the textured wall surface and so can be quickly painted onto the part of the wall of interest, hardening in situ to leave a suitable impression.

Optionally, during step b. the moulding element may be hardened forming the impressing element. The impressing element directly forming the moulding element prevents any need of an intermediate impression and so simplifies and streamlines manufacturing.

Additionally, in step g. said curing may include flash heating. Flash heating enables evaporation of water within the wet mixture and hardening of the wet mixture at the same time. Therefore, steam percolating through the wet mixture may form channels through the hardening wet mixture which ensures that the wet mixture is vapor permeable and thereby allows the substrate support beneath to breathe.

Preferably, in step g. said curing may include applying heat and air to maintain porosity and flexibility. The application of air as well as heat increases the rate of curing.

Advantageously, the method may further comprise a step h. subsequent to step e. of applying further powdered aggregate to the wet mixture for better matching the cladding outer surface to the textured wall surface of the wall. A further powdered aggregate layer, which bonds to the wet mixture underneath, can allow for multiple colours of powdered aggregate to show through on the cladding, thereby increasing a natural look of the cladding.

Beneficially, the method may further comprise the step i. subsequent to step g. of applying a flexible or elastic grouting layer to the flexible substrate for better matching the cladding outer surface to the textured wall surface of the wall. Grouting between tiles can mimic the appearance of mortar between bricks, thereby providing a more realistic appearance. By using grouting for this purpose, rather than traditional cement and/or lime compounds, the dangers of efflorescence and lime bloom are mitigated.

Optionally, in step d. the wet mixture may be colour-matched to the wall of the building. Colour matching provides a more realistic and natural effect, in keeping with the building's original appearance and/or those which surround it.

Additionally, in step d. said binding agent may be polymeric. A polymeric binding agent, in particular a resin-based agent, is advantageous for use in the cladding wrap, since it is sufficiently adhesive to bond the layers together, whilst being sufficiently viscous to permeate through the porous layer. The binding agent is also weather resistant, which is a primary concern for an exterior cladding.

Preferably, wherein during step g. the tiles are cured into flexible tiles. The tiles being flexible enables the cladding to be wrapped and/or curved along or across the whole extent of the cladding, as compared to only the substrate being flexible and so the cladding would only be flexible at the spaces between the tiles.

Advantageously, during step e, a template for forming a plurality of spaced apart wall tile slips may be positioned on the absorbent flexible substrate prior to application of wet mixture. A template allows for the tiles to be formed with more accurate and precise dimensions in a time efficient manner.

According to a second aspect of the present invention, there is provided a building-wall-flexible-cladding manufacture system for manufacturing building-wall flexible cladding having a cladding outer surface which matches or substantially matches at least part of a textured wall surface of a building, the system comprising: a manufacturing assembly having: a movable substrate support for supporting a flexible substrate of the building-wall flexible cladding, a wet mixture applicator for applying wet mixture to the flexible substrate so as to form one or more tiles, an impression applicator for applying an impression of at least part of said textured wall surface of the building to the wet mixture so that the cladding outer surface corresponds or substantially corresponds to said textured wall surface, the movable substrate support being movable from the wet mixture applicator to the impression applicator; and a curing means for curing the wet mixture.

The manufacture system allows for the at least part of the manufacturing of the building-wall flexible cladding to be automated. This can allow for efficient and repeatable manufacturing. The impression applicator allows for a relief of the wall to be applied to the cladding, so as to more accurately replicate a weathered wall. This impression applicator may apply the impression of the wall to which the cladding is to be fixed, the impression of a different wall or a virtual wall.

Preferably, the impression applicator may include an impressing element which is actuatable towards the movable substrate support to directly contact the wet mixture to apply the impression. An impressing element is able to quickly and inexpensively texture the wet mixture through physical deformation of the wet mixture, as compared to casting the wet mixture with such a texture or laser cutting the wet mixture.

Advantageously, the curing means may include a heating element, and the movable substrate support is movable from the impressing element to the heating element. A heating element enables the application of heat for flash curing, the advantage of which is described above.

Beneficially, there may be a plurality of said heating elements, the movable substrate support being movable to each heating element. The movable substrate support may be movable periodically, waiting at each part of the assembly for the associated manufacturing processes can be applied to the substrate on the substrate support. Each process may take approximately the same length of time, with the exception of the heating step which may take significantly longer. Therefore, should a plurality of movable support elements be used with each being at a different stage in the manufacturing process, a plurality of heating elements may be required to heat the wet mixture for the desired length of time whilst still enabling the movable support elements to move in synchrony with each other.

Additionally, the manufacturing assembly may further include a template for applying the wet mixture to so as to form one or more tiles on the substrate support. A template allows for the tiles to be formed with more accurate and precise dimensions in a time efficient manner.

Preferably, the building-wall-flexible-cladding manufacture system may further comprise a moulding element for application to said textured surface of the wall so that the moulding element adopts a texture of the textured surface of the wall. A physical moulding element enables the impression of the relief of the wall to be formed simply and without requiring complex scanning equipment.

Optionally, the moulding element may include latex. Latex may be applied in a liquid form to the textured wall surface and so can be quickly painted onto the part of the wall of interest.

Preferably, the movable substrate support comprises a plurality of movable support element, each support element being circulatable around a circulation path. A plurality of movable supports enables multiple cladding elements to be manufactured at the same time in an assembly line.

According to a third aspect of the present invention there is provided building-wall-flexible-cladding comprising: an absorbent flexible substrate for application to a wall of a building; and a plurality of tiles attached to the absorbent flexible substrate; each tile having an outer surface with an impressed impression thereon which matches or substantially matches a textured wall surface.

The invention will now be more particularly described, by way of example only, with reference to the accompanying drawings, in which.

Figure 1:
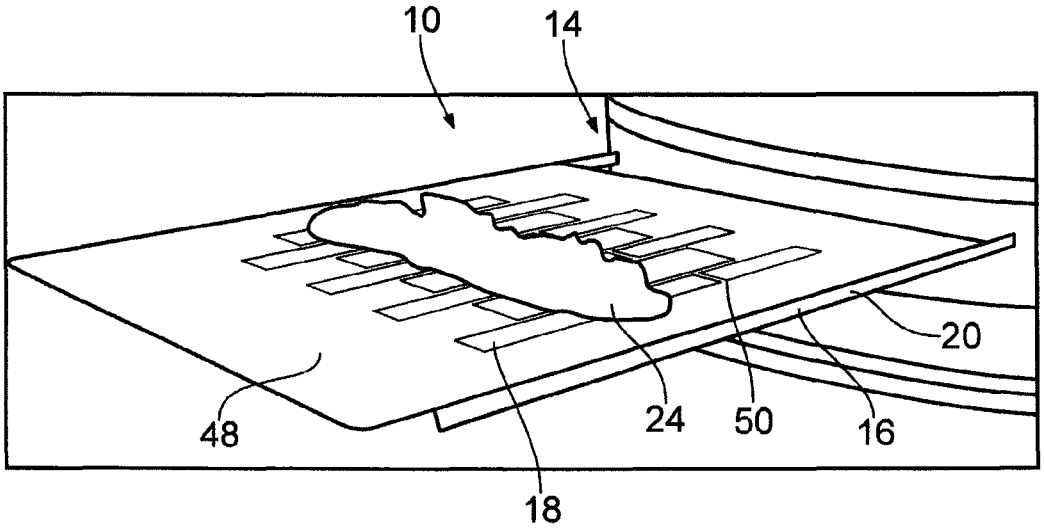
FIG. 1 shows a perspective view of a movable substrate support of a manufacturing assembly of one embodiment of a building-wall-flexible-cladding manufacture system in accordance with the second aspect of the present invention with in use wet mixture on an in use flexible substrate and on a template.

Referring firstly to FIGS. 1 to 8 there is shown a building-wall-flexible-cladding manufacture system 10 for manufacturing building-wall flexible cladding 12 having a cladding 12 outer surface which matches or substantially matches at least part of a textured wall surface of a building.

The building-wall-flexible-cladding manufacture system 10 firstly comprises a manufacturing assembly 14. The manufacturing assembly 14 includes a movable substrate support 16, which can be seen throughout FIGS. 1 to 8, for supporting a flexible substrate 18 of the building-wall flexible cladding 12. The movable substrate support 16 here includes a plurality of planar support elements 20, each of which are for supporting an individual flexible substrate sheet 18, are automatically movable along a path or track and are spaced apart from one another. Therefore, each planar support element may be dimensioned to the size of the flexible substrate sheet. The support elements 20 are here linked so that they move in synchrony, although it will be appreciated that the support elements 20 may be independently movable. To move the substrate support a drive element, such as a chain and motor, may be employed.

Whilst there is here a plurality of support elements 20, it will be appreciated there may only be one support element 20. Additionally or alternatively, the support element 20 may take the form of a continuous conveyor belt.

The track of the movable substrate support 16 is here continuous such that it forms a loop. In this way each support element 20 is circulatable around the track and is thus movable around an endless path and/or circulatable.

The manufacturing assembly 14 further comprises a wet-mixture applicator 22 for applying wet mixture 24 to the flexible substrate 18 so as to form one or more tiles 24*a*. Therefore, the wet-mixture applicator 22 is preferably positioned at or adjacent to the path of the movable substrate support 16. In the prototypical embodiment illustrated, the wet-mixture applicator 22 comprises a wet-mixture depositor, deposited in use wet mixture 24 being shown in FIG. 1, and a wet-mixture distributor 22*a*, as shown in FIG. 2, which are positioned at, adjacent to and at separate and/or spaced apart positions with respect to the path. However, it will be appreciated that the wet-mixture depositor and the wet-mixture distributor 22*a* may be combined and/or positioned at the same place.

The wet-mixture depositor is for initially providing, depositing or positioning wet mixture 24 on or at the flexible substrate 18. Here the wet-mixture depositor comprises a person who manually deposits wet mixture 24 on the in use flexible substrate 18. However, it will be appreciated that the wet-mixture depositor may be automatic, for example it may be a conduit with an outlet and valve at the movable support, and having a wet mixture supply such that wet mixture is directed to or on the movable support.

The wet-mixture distributor 22*a* is preferably mechanised and/or automatic. Here it includes a first elongate distributing element 26*a* and a second elongate distributing element 26*b*. These may be similar to plastering trowels or plastering spatulas. The distributing elements 26*a*, 26*b* are spaced apart and positioned so that their longitudinal extents are parallel to each other. The distributing elements 26*a*, 26*b* are movable towards and away from the path and/or movable substrate support 16, for example up and down. A spreading edge of each distributor 26*a*, 26*b* may act to spread or smear in use wet mixture 24. This movement is here achieved via actuators and/or pistons. The first distributing element 26*a* is preferably movable independently with respect to the second distributing element 26*b*. The distributing elements 26*a*, 26*b* are also together movable across or along the movable substrate support 16 and/or the path. This movement is achieved via mounting the distributing elements 26*a*, 26*b* to a rail 28. Whilst described as being automatic or mechanised, it will be appreciated that the wet-mixture distribution may in fact be a manual process. Whilst two distributing elements 26*a*, 26*b* are described, it will be appreciated that there may be only one distributing element, or more than two.

Figure 3:
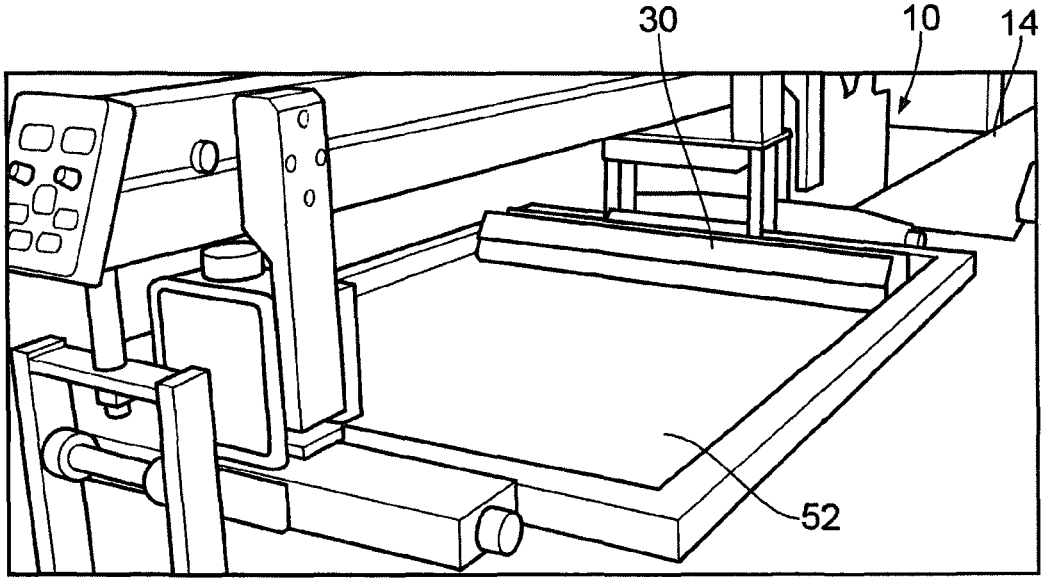
FIG. 3 shows a further wet mixture applicator of the manufacturing assembly of FIG. 1.

Referring to FIG. 3, the manufacturing assembly 14 further comprises a further wet-mixture applicator 30 which may be positioned at or adjacent to the path of the movable substrate support 16 and after the initial wet-mixture applicator 22.

Figure 4:
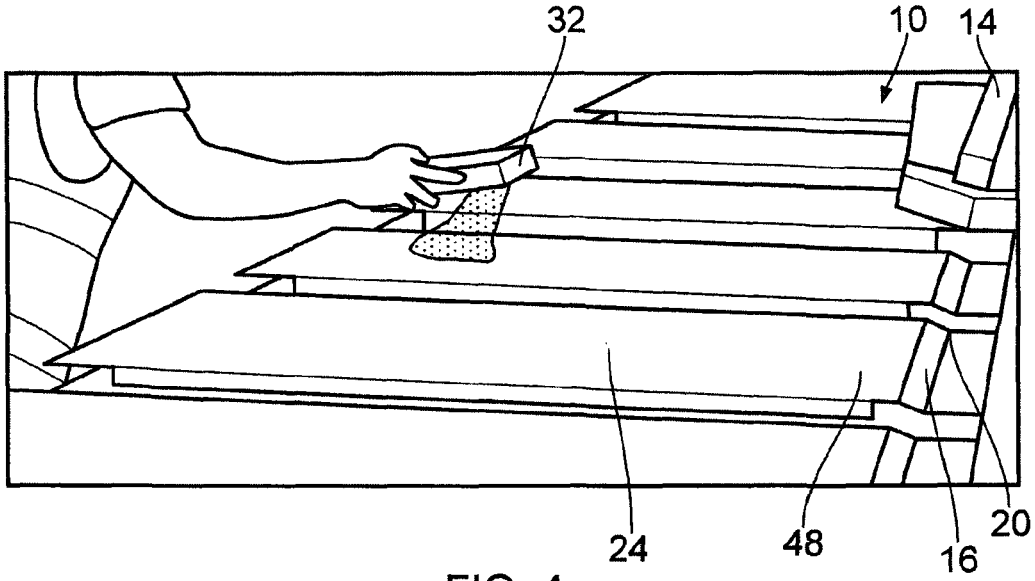
FIG. 4 shows a powdered aggregate applicator of the manufacturing assembly of FIG. 1, applying further powdered aggregate.

Referring to FIG. 4, the manufacturing assembly 14 further comprises a powdered-aggregate depositor 32. The powdered-aggregate depositor 32 here comprises a container for receiving powdered aggregate, the container having an outlet which is positioned above the movable substrate support 16. The outlet may include a grill, filter or sieve to prevent or limit powder of a greater than desired particle size from being deposited form the container. The container may be moved, oscillated or vibrated so that powdered aggregate may fall through the grill. Here the container is manually movable across or along the path of the movable substrate support 16 and manually oscillatable to encourage powder deposition, although it will be appreciated that these processes may be automated or mechanised.

Figure 5:
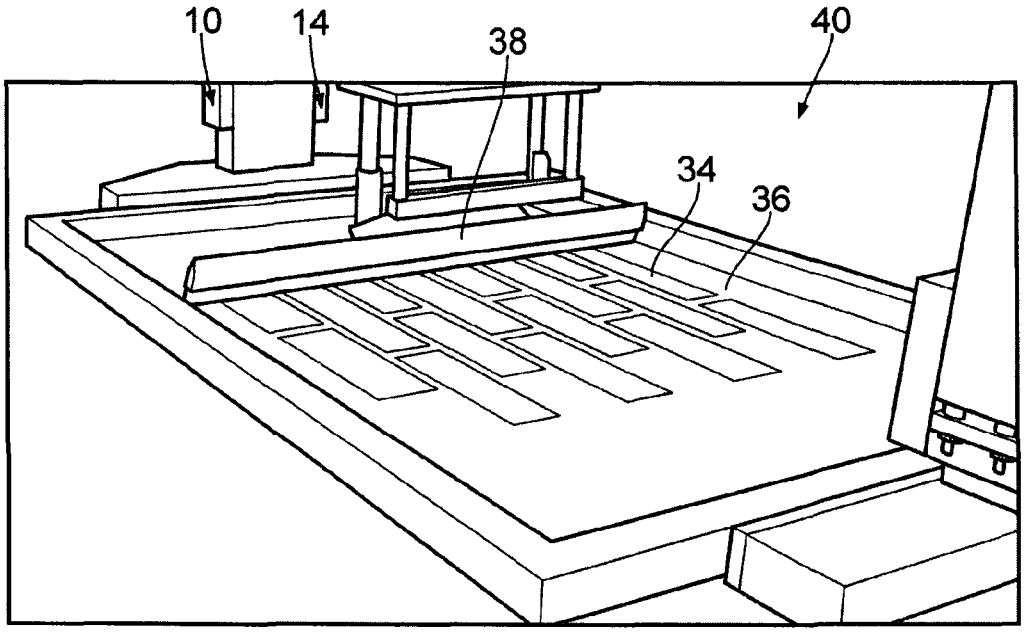
FIG. 5 shows an impression applicator of the manufacturing assembly of FIG. 1, applying an impression to wet mixture.
Figure 6:
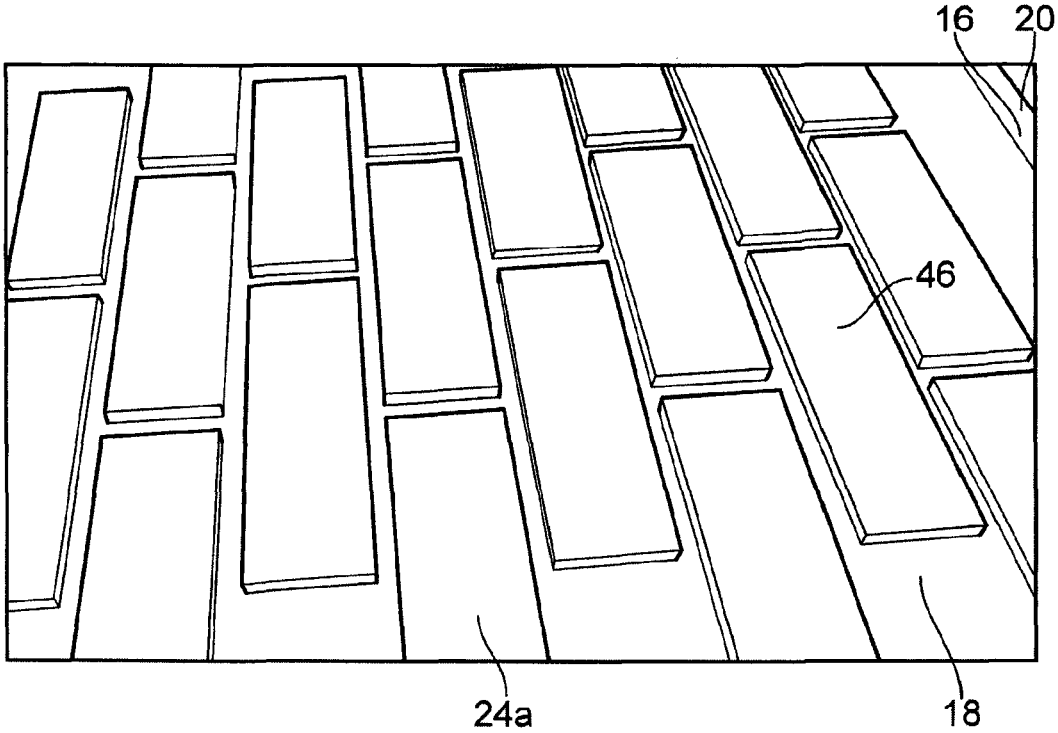
FIG. 6 shows wet mixture having had an impression applied by the impression applicator of FIG. 5.

Referring to FIG. 5, the manufacturing assembly 14 further comprises an impression applicator 34 for applying an impression of said textured wall surface of the building. The impression applicator 34 is positioned at or adjacent to the path of the movable substrate support 16, preferably in line after the powdered-aggregate depositor 32.

The impression applicator 34 here comprises an impressing element 36 for directly impressing the wet mixture 24 on the flexible substrate 18. The impressing element 36 may otherwise be considered to be a moulding element, stamping element or embossing element. The impressing element 36 preferably has an impression of the part of the textured surface of the wall to be modelled. The wall may be the same wall or a different wall to that which the cladding 12 is to be fixed. The impression has a relief, surface, surface texture or three-dimensionally surface which is the opposite, the inverse or corresponds to that of the wall. For example, if a recess or depression is in the wall, the impressing element 36 may have a corresponding protrusion, this is so that, when the impressing element 36 presses or stamps the wet mixture 24, the protrusion will leave a corresponding recess in the wet mixture 24. A textured building-wall flexible cladding 12 element is shown in use in FIG. 6.

The impressing element 36 may preferably be formed from latex and may therefore be flexible or substantially flexible, although any other material may be considered. Additionally, it will be appreciated that the impressing element 36 may be formed from a non-stick material or have a non-stick coating so that impressed wet mixture 24 does not remain on the impressing element 36.

The impressing element 36 is movable towards and away from the movable substrate support 16. Here the movement is up and down so as to create a stamping action. The impression applicator 34 further comprises an elongate pressing member 38 which is here movable towards and away from the impressing element 36, by virtue of actuators and/or pistons, and is movable along or across a rear surface of the impressing element 36, by virtue of being movably mounted on a rail 40, which may be similarly formed as the rail 28 associated with the wet-mixture depositor 22*a*.

The impressing element 36 is here plate-like in shape or substantially planar. However, it will be appreciated that the impressing element 36 may in fact be a roller, having an impression of the wall around the curved surface of the roller.

Figure 7:
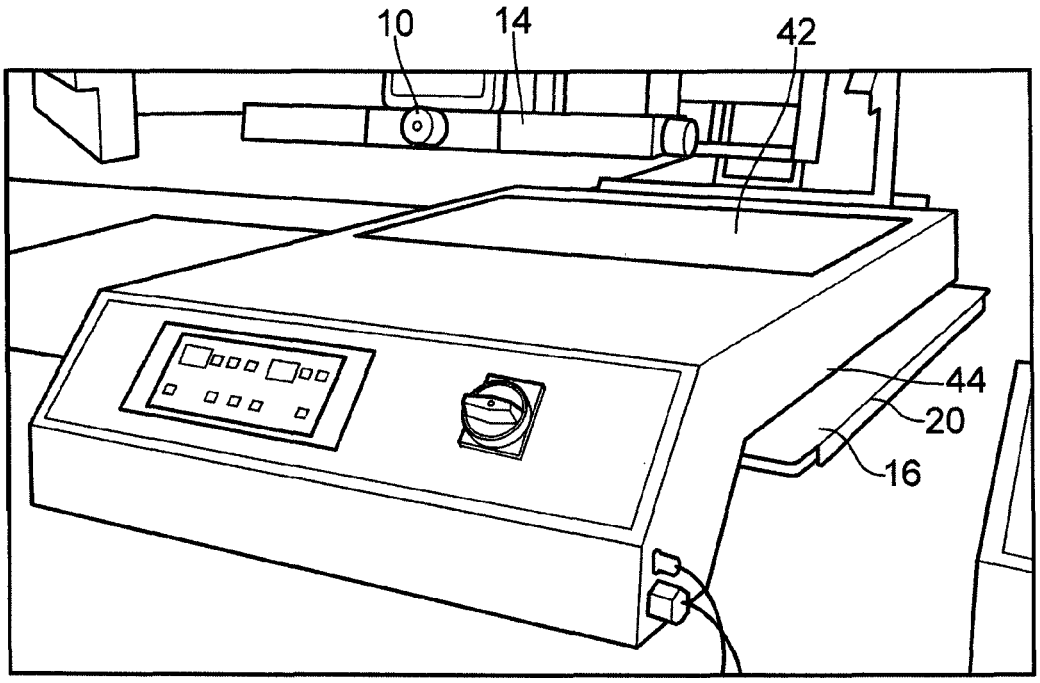
FIG. 7 shows a curing means of the building-wall-flexible-cladding manufacture system of FIG. 1, curing the wet mixture of FIG. 6 which had been impressed.
Figure 8:
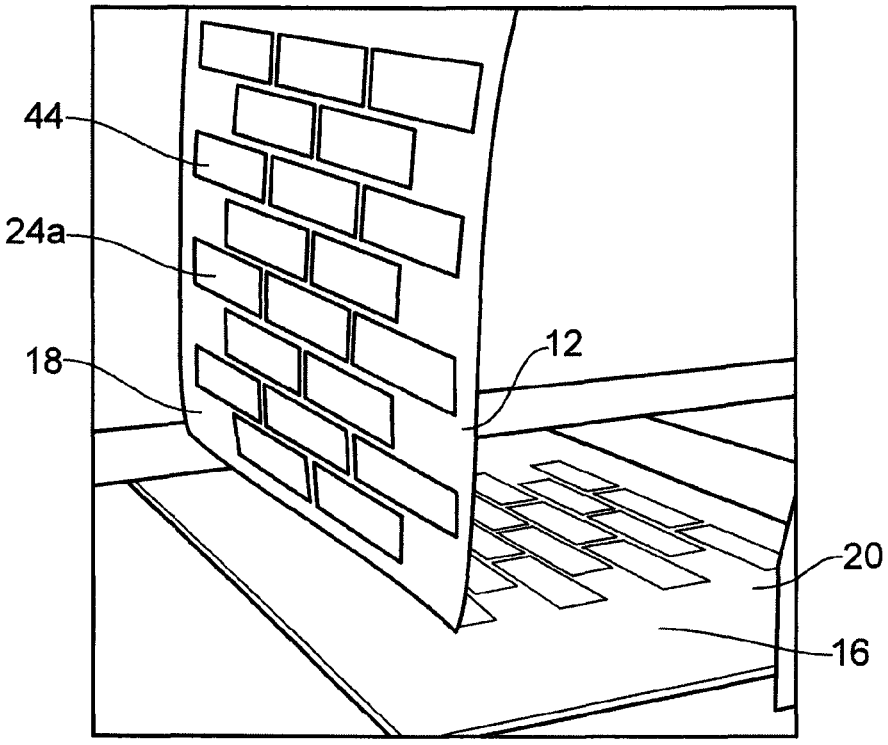
FIG. 8 shows a building-wall flexible cladding element in accordance with a third aspect of the present invention, having been made by the building-wall-flexible-cladding manufacture system of FIG. 1.

Referring to FIG. 7, the building-wall-flexible-cladding manufacture system 10 further comprises a curing means 42 for curing the wet mixture 24. The curing means 42 preferably includes a heating element 44 which is positioned at, adjacent to or above the path of the movable substrate support 16. Here there are two heating elements 44, positioned adjacent to each other, although it will be appreciated that there may only be a single heating element 44 or more than two heating elements 44. At least in part cured wet mixture is shown in FIG. 8.

Whilst described as a heating element 44 it will be appreciated that the curing means 42 may not necessitate the inclusion of a heating element 44. For example, the wet mixture 24 may be air-cured only by moving the flexible substrate 18, with textured wet mixture 24 thereon, away from the manufacturing assembly 14 and left so that the wet mixture 24 is cured.

The building-wall-flexible-cladding manufacture system 10 may further comprise a moulding element for application to said textured surface of the wall so that the moulding element adopts a texture of the textured surface of the wall. The moulding element may here include or be formed from latex.

Figure 9:
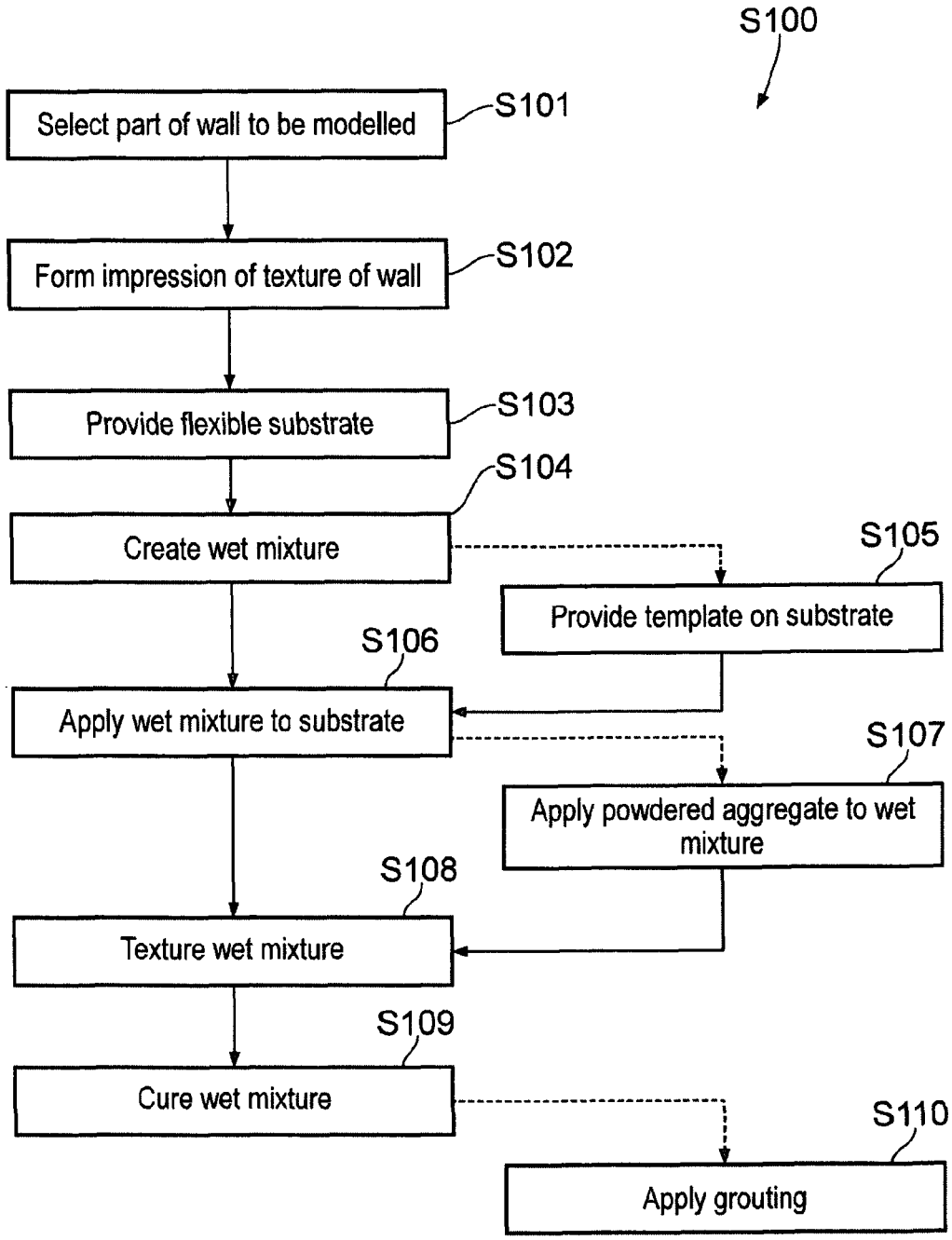
FIG. 9 shows a representation of a method of manufacturing building-wall flexible cladding, the method in accordance with the first aspect of the present invention.

Referring to FIG. 9, there is depicted a method S100 of manufacturing building-wall flexible cladding 12, at least in part using the building-wall-flexible-cladding manufacture system 10 as previously described, for a wall of a building so that a cladding outer surface 46 of the building-wall flexible cladding 12 matches or substantially matches a textured wall surface of the wall of the building.

The textured wall surface of the building is preferably the three-dimensional surface, relief and/or surface texture of the wall. The wall to be matched is preferably an exterior wall of the building, although interior walls, ceilings or rooves may also be considered.

Firstly, the method S100 includes the step of selecting at least part of the textured wall surface to be modelled or matched S101. The part of the wall may be selected due to its texture or relief being broadly representative of the entirety of the wall on which cladding 12 is to be installed and/or the most aesthetically pleasing.

Next the method S100 includes forming an impression of said selected part of the textured wall surface S102. The impression may be a physical impression and so may be formed by applying a moulding element to said textured wall surface so that the texture of the wall is impressed into the moulding element. The moulding element may be applied to the wall as an emulsion, for example a latex emulsion, and therefore may be painted onto the selected part of wall. Once dried, the moulding element may be carefully removed or peeled from the wall and would thereby retain the impression of the textured wall surface. Alternatively, the moulding element may be a meltable solid which has a relatively low melting point, which is melted and, once liquid, applied to the wall. After solidification, the moulding element may be removed and retain the impression of the textured surface of the wall. Other examples of forming a physical impression of the textured wall surface include plaster casting or using a deformable solid element.

Should the moulding element be sufficiently resilient, the moulding element may be able to directly form the impressing element 36 for texturing of the wet mixture 24. Therefore, the impression formed from the textured wall surface and that which textures the cladding 12 outer surface would be one and the same. Alternatively, the impressing element 36 may be generated by making a cast of the moulding element. Therefore, the impression formed form the textured wall surface and that which textures the cladding 12 may be identical but do not need to be one and the same. Additionally or alternatively, in either case, the impression of the textured surface of the wall may be customised, adjusted or altered so that the impressing element 36 does not have a texture which directly matches that of the impression. This may be so as to create a more convincing or desirable finish to the cladding 12 outer surface.

In the event that the textured surface of the wall includes bricks or tiles 24*a*, the impression which is formed may therefore include outlines of these bricks of tiles 24*a*. It may be that the impression is intended to texture cladding 12 which is desired to have a different arrangement of bricks or tiles 24*a* to that of the wall. For example, the wall to be modelled may have a stretcher bond brickwork pattern and the cladding 12 may have a stacked bond brickwork pattern. In this instance the impression would be required to be modified so as to not include the outline of the bricks or the mortar, and only the texture of surface of the brick. In this way the same impression could be used to texture cladding 12 having different brickwork patterns to that of the wall from which the impression was derived. Therefore, the assembly using the same impression could produce textured cladding having a variety of brickwork patterns.

Alternatively, the impression may be an electronic impression and may be formed by scanning the textured wall surface. This may be achieved through laser scanning, such as LIDAR; structured-light three-dimensional scanning, modulated-light three-dimensional scanning or any other form of three-dimensional imaging. The relief of the textured wall surface may therefore be read or measured before being electronically reproduced to form the electronic impression. Alternatively or additionally, the physical impression may first be formed via the moulding element before being scanned off-site to form the electronic impression. The electronic impression may then be formed into the physical impressing element 36, for example via three-dimensional printing or Computer Aided Manufacture.

The aforementioned building-wall-flexible-cladding manufacture system 10 can then be used to manufacture the building wall flexible cladding 12. Here the cladding 12 may take the form of discrete cladding sheets or wraps 12.

The absorbent flexible substrate 18 is provided S103 and/or positioned on the movable substrate support 16. Preferably the absorbent flexible substrate 18 is a pliant and porous woven or non-woven sheet. It is here formed from discrete substrate sheets 18 and each substrate sheet 18 may be positioned on a separate support element 20 of the movable substrate support 16.

Although preferably entirely flexible and/or porous, one or more portions may not be flexible and/or porous as necessity dictates. The substrate 18 may be a polymeric fibrous matrix, for instance, a polypropylene mesh, and/or natural fibre weave, such as cotton. Dimensions in this case may advantageously be 700 mm by 760 mm, but a size may vary to suit requirement. The porosity is derived from the open or substantially open fluid-permeable or liquid-permeable weave or structure which in turn provides the absorbent nature of the substrate.

A wet mixture 24 is created S104 comprising a powdered aggregate and a binding agent. The binding agent may conveniently be a polymeric binding agent and/or resinous compound which preferably remains flexible or malleable once the wall-tile 24*a* slips are heated or cured. The solid material is preferably a particulate material and may additionally be 'as dug reclaimed' material. The term 'as dug reclaimed' is well known in the technical field, and relates to material extracted from the ground, such as a quarry, and preferably without treating is then utilised or ground to be accommodated in the wet mixture 24. The particulate matter may be inorganic or organic, and may be recycled castoff material, typically comprising at least one of brick, stone or rock. The material will be chosen primarily for its aesthetic appeal, so as to match the external appearance of the building to which it is being affixed. For example, brick and/or sandstone aggregates might be common choices for the aggregate.

To achieve the desired finish, thereby allowing matching or substantial matching to the building's local, historic or architectural environment and/or its original finish, the powdered aggregate may be pigment colour-matched using a system similar to that used for colour matching paint or other liquid coating products. The colour scheme of a visible surface of an existing building is determined, for example, using a reflectometer, if required, and the wet mixture 24 is colour matched to the determined colour scheme by the addition of pigment. In this way, during formation of the powdered aggregate, the correct colour and texture of materials can be chosen to produce the required finish.

Figure 2:
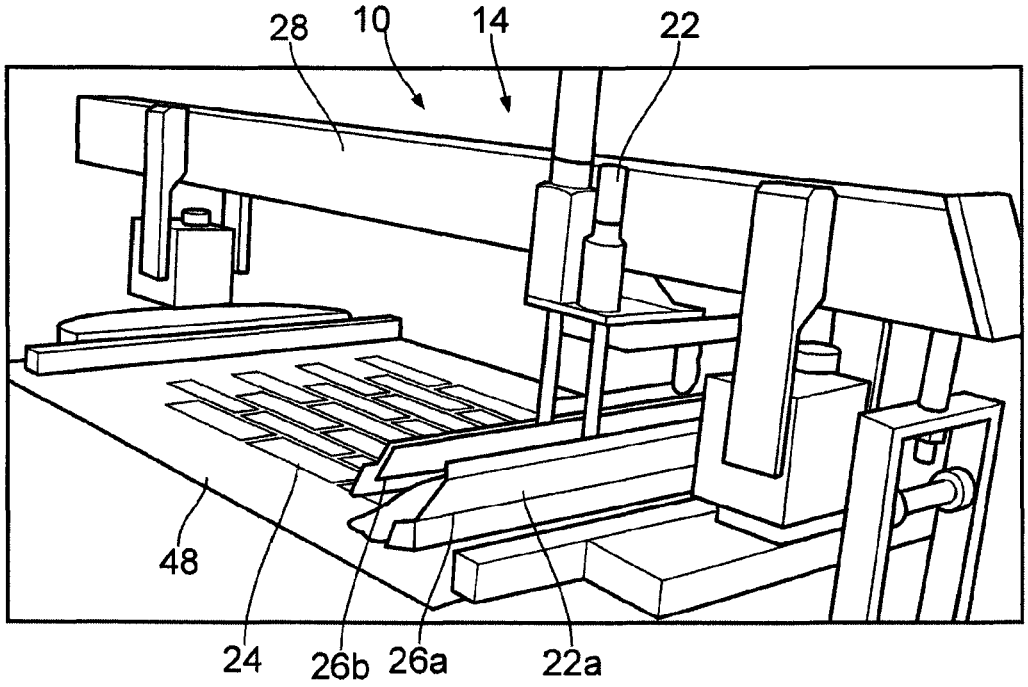
FIG. 2 shows part of a wet mixture applicator of the manufacturing assembly of FIG. 1, with in use wet mixture spread into the template on the flexible substrate of FIG. 1.

As shown in FIG. 1, a control template 48 for forming a plurality of spaced apart wall-slip tiles 24*a* is next preferably positioned on the absorbent flexible substrate S105. The control template 48 controls at least a spacing between a plurality of wall-tile 24*a* to be formed. In this case, the control template 48 determines a volume of material to be utilised for each wall-tile 24*a*. This is achieved by the control template 48 having a plurality of apertures 50, in this case being rectangular or substantially rectangular.

A body of the control template 48 is planar or substantially planar, defining a rectangular perimeter extent. Other perimeter shapes are possible, such as square, circular or non-circular. The body preferably has a uniform thickness, and in this embodiment the thickness may be in the range of 1 mm to 15 mm, and more preferably around 5 mm. With a uniform or substantially uniform thickness, a depth of each slip can be controlled, and with predetermined longitudinal and lateral extents of each aperture 50, an area of each slip can be controlled.

Each aperture 50 is dimensioned to match or substantially match a brick, stone or rock, dependent on wall to which the cladding 12 is to be applied. The apertures 50 may preferably be aligned in a, preferably uniform, overlapping stacked arrangement with an equal or substantially equal spacing therebetween, equating to a typical mortar course. To provide greater realism or authenticity, the spacing between the apertures 50 may not be entirely uniform, with a tolerance variance of around 0 mm to 5 mm, and more preferably 0 mm to 2 mm.

In the current embodiment, twenty apertures 50 are provided in alternating rows of two and three apertures 50, lengthwisely aligned and stacked in overlapping manner whereby apertures 50 in neighbouring rows are equi-distantly bridged.

It is intended that an aperture 50 of each control template 48 houses or substantially houses material used for each tile or slip 24*a*, thereby providing reliable dimensional control during production. However, it is feasible that tiles 24*a* having irregular depths could be produced. In this case, an upper surface of the control template 48 may be non-planar. Equally, the longitudinal and/or lateral extents of two or more of the apertures 50 may not be matching or substantially matching, again as necessity dictates dependent on the installation site. This may be useful for stone- or rock-effect finishes or facades as opposed to a brick finish.

Whilst a control template 48 is described, it will be appreciated that a control template 48 may not be necessary and, for example, wet material may be directly deposited or applied in the form of wall slips 24*a* on the absorbent flexible substrate 18.

Wet mixture 24 is then applied to the substrate S106. The support element 20, with a substrate sheet 18 thereon, is moved to the wet-mixture depositor. Wet mixture 24 is there deposited on top of the flexible substrate 18 and on, next to, at or adjacent to the control template 48.

The support element 20 then moves to the wet-mixture distributor 22*a*. The distributing elements 26*a*, 26*b* are lowered towards the template 48 with the first distributing element 26*a* raised above and out of reach of the deposited wet mixture 24. The second distributing element 26*b* is spaced apart from the template 48; however, it is low enough to engage the wet mixture 24. The distributing elements 26*a*, 26*b* are then moved across the template 48 such that the second distributing element 26*b* roughly spreads wet mixture 24 into the apertures 50 of the template 48 and onto the substrate. The first distributing element 26*a* is then lowered so as to engage the template 48 and the distributing elements 26*a*, 26*b* are moved back across the template 48, the first distributing element 26*a* more evenly spreading wet mixture 24 into the template 48 apertures 50. This thereby forms tiles 24*a* or wall-slip tiles on the substrate. This process may be repeated so as to ensure a more even distribution of wet mixture 24 in the apertures 50 of the template 48. The distributing elements 26*a*, 26*b* are then moved away from the support element 20 and the movable support element 20 moves onto the further wet-mixture applicator 30. By virtue of the porosity of the flexible substrate 18, wet mixture 24 can permeate the porous flexible substrate 18.

The further wet-mixture applicator 22 applies a thin coating of further wet mixture 52 to the wet mixture 24 already present on the substrate 18. Preferably the further wet mixture 24 is of or has a powdered aggregate which is of a different colour or pigment to the wet mixture 24 which was initially applied. This may enable the production of a more natural appearance.

The support element 20 is moved to the powdered-aggregate depositor 32. Powdered aggregate is then applied as an additional layer to the wet mixture S107. This enables an option of a different powdered aggregate to that which was used to form the wet mixture 24. A base colour or appearance with patches of weathering or other random anomalies appearing thereon, such as in-grained dirt or other particulate debris or detritus which ordinarily build up through years of standing in the open environment and being subjected to all kinds of weather, can therefore be provided.

The support element 20 is next moved to the impression applicator 34 to texture the wet mixture S108. The impressing element 36 having the impression thereon is moved towards the wet mixture 24 such that it engages and textures the wet mixture 24 which is in the apertures 50 of the template 48. In this way the impressing element 36 impresses, stamps, embosses or moulds the wet mixture 24 with the impression of the textured wall. The elongate pressing member 38 engages and moves across the rear of the impressing element 36 so that the impression is pressed more firmly into the wet mixture 24. This ensures that a more defined impression is formed. An impression is thereby formed in or on the wet mixture 24 of the impressing element 36, which in turn has the impression of the textured surface of the wall. Therefore, the surface of the wet mixture 24 matches or substantially matches the textured surface of the wall. Given the multiple layers of wet mixture 24 and the further powdered aggregate, all of which may be different colours, by impressing the wet mixture 24 the different layers may be visible, providing a more realistic and/or weathered effect.

Whilst described as being a physical impressing element, it will be appreciated that the impression applicator may alternatively texture the wet material according to the impression via laser cutting. In this way the electronic impression would be used as a guide or model to direct or manoeuvre the laser cutter to texture the surface of the wet material.

After texturing the wet mixture 24, the template 48 is preferably removed from the support element 20. Therefore, the wet material may be of such a consistency so as to remain in place without support from the template 48, and at least temporarily maintain the surface texture imparted by the impression applicator 34 before curing S109. The textured wet material is then flash heated, which is part of the curing process. This is here achieved by moving the support element 20 at adjacent to and preferably underneath the heating element 44 and activating the heating element 44. The wet mixture 24 may be heated at a temperature preferably in the range of 80° C. to 300° C., more preferably in the range of 100° C. to 250° C. and most preferably in the range of 125° C. to 200° C. Preferably, the wet material is cured under the heating element 44 for between 10 and 30 seconds, and is here flash heated for 20 seconds. The flash heating forms steam from the wet mixture which percolates through the wet mixture 24. This process ensures that the flexible tile 24*a* is fully vapour permeable allowing the substrate layer beneath to breath. Here the support element 20 is cured under two separate heating elements 44 in two stages. This allows for a longer total heating time, despite the requirement of the support element 20 at the heating stage to move in synchronicity with the support elements 20 undergoing the preceding steps, each preceding step here taking less time to complete than the total heating time.

The wet mixture 24 is therefore at least in part hardened and/or set, here forming multiple tiles 24*a* on the substrate sheet. The tiles 24*a* are attached and/or adhere to the substrate sheet at least by virtue of the wet mixture 24 absorbing through the porous substrate sheet and then hardening and/or by virtue of the polymeric binding agent. As shown in FIG. 8 the substrate sheet with hardened wet mixture 24 in the shape of tiles 24*a* thereon can therefore be lifted and orientated vertically before being transported to a curing station. The curing of the hardened wet mixture 24 may therefore be completed preferably by hanging the substrate sheet with the hardened wet mixture 24 for 24 hours at around 19° C. In this case, the curing station comprises a hanging rack, whereby each substrate sheet is hung via its associated holder.

After curing of the bricks, a rear surface of the absorbent flexible substrate 18, which does not have the tiles 24*a* thereon, is overlain and bonded to a backing support substrate. The backing support substrate may be similarly formed to the absorbent flexible substrate 18 and the two may be adhered together using the aforementioned or a different polymeric binding agent. A rear surface of the backing support substrate may in use engage the wall on which the cladding 12 is to be installed.

Having been cured, elastic grouting may be applied S10 to the flexible substrate 18 in between tiles 24*a* so that the cladding 12 outer surface better matches the textured wall surface of the wall.

The impression of the textured wall surface may be derived from the same wall that the flexible cladding 12 is to be applied. However, it will be appreciated that the impression may be derived from a different wall to that which the cladding 12 is to be applied. Alternatively, the impression may be artificially generated and therefore not relate or be derived from any specific real wall.

It is therefore possible to provide a method of manufacturing flexible cladding for a wall of a building having a cladding outer surface which has a relief which corresponds or substantially corresponds to that of the wall or a different wall. Additionally, it is therefore possible to provide a system for manufacturing such flexible cladding.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A method of manufacturing building-wall flexible cladding for a wall of a building so that a cladding outer surface of the building-wall flexible cladding matches or substantially matches a textured wall surface of the wall of the building, the method comprising the steps:

a. selecting at least part of the textured wall surface to be modelled;

b. forming an impression of said selected part of the textured wall surface;

c. providing an absorbent flexible substrate;

d. creating a wet mixture comprising a powdered aggregate and a binding agent;

e. applying the wet mixture to the flexible substrate to form one or more tiles;

f. texturing the wet mixture by applying the impression so that the cladding outer surface corresponds or substantially corresponds to the said textured wall surface; and g. curing said textured wet mixture to form building-wall flexible cladding.

2. A method as claimed in claim 1, wherein during step b. an impressing element is formed using the impression and during step f. the impressing element applied to the wet mixture.

3. A method as claimed in claim 2, wherein the impressing element is stamped onto the wet mixture.

4. A method as claimed in claim 1, wherein in step b. the impression is formed via applying a moulding element to said textured surface of the wall.

5. A method as claimed in claim 4, wherein the moulding element comprises latex.

6. A method as claimed in claim 4, wherein during step b. an impressing element is formed using the impression and during step f. the impressing element is applied to the wet mixture, and wherein during step b. the moulding element is hardened forming the impressing element.

7. A method as claimed in claim 1, wherein step g. includes at least one of: said curing including flash heating;

said curing including applying heat and air to maintain porosity and flexibility; and the tiles being cured into flexible tiles.

8. A method as claimed in claim 1, further comprising a step h. subsequent to step e. of applying further powdered aggregate to the wet mixture for better matching the cladding outer surface to the textured wall surface of the wall.

9. A method as claimed in claim 1, further comprising the step i. subsequent to step g. of applying a flexible or elastic grouting layer to the flexible substrate for better matching the cladding outer surface to the textured wall surface of the wall.

10. A method as claimed in claim 1, wherein step d. includes at least one of: the wet mixture being colour-matched to the wall of the building; and said binding agent being polymeric.

11. A method as claimed in claim 1, wherein during step e, a template for forming a plurality of spaced apart wall tile slips is positioned on the absorbent flexible substrate prior to application of the wet mixture.

* * * * *